United States Patent [19]

Cornwell

[11] 3,932,802

[45] Jan. 13, 1976

[54] CONTROLLED POWER TRANSFERRING DEVICE AND METHOD UTILIZING A REACTANCE CONTROLLED BY DEVELOPMENT OF OPPOSING MAGNETIC FLUXES

[76] Inventor: Lionel B. Cornwell, 52 Madison Springs Drive, Madison, Conn. 06443

[22] Filed: July 12, 1974

[21] Appl. No.: 487,875

[52] U.S. Cl. ..... 323/6; 323/62; 323/86

[51] Int. Cl.[2] ..... G05F 1/20

[58] Field of Search ..... 323/8, 85, 86, 87, 88, 323/49, 6, 50, 62, 57, 60

[56] References Cited

UNITED STATES PATENTS

| | | | |
|---|---|---|---|
| 2,497,218 | 2/1950 | Hart | 323/86 |
| 3,436,600 | 4/1969 | Salo | 323/88 |
| 3,466,531 | 9/1969 | Chin | 323/86 |
| 3,624,491 | 11/1971 | Fidi et al. | 323/62 |

*Primary Examiner*—Gerald Goldberg
*Attorney, Agent, or Firm*—Joseph L. Lazaroff

[57] ABSTRACT

A power transferring method and device of the controlled reactance type designed to regulate or control the application of alternating current electric power to a load. Reactance is controlled by using the signal to be controlled to develop a controlled magnetic flux in opposition to the reactive magnetic flux, the resulting flux cancellation effectively eliminating reactance. The device includes a reactance means with a core and a first coil around the core to be connected into the circuit in which power transfer is to be controlled. The opposing magnetic flux in the core is developed by a second coil around the core and having one end connected to one end of the first coil. Controllable means, such as an SCR, connect the other end of the first coil to the other end of the second coil to place the two coils in parallel. The coils are arranged on the reactor core so that parallel currents through the coils produce opposing magnetic fluxes in the core. By selective operation of the controllable means, the reactance of the device can be varied over a wide range with efficient power transfer.

14 Claims, 4 Drawing Figures

CONTROLLED POWER TRANSFERRING DEVICE AND METHOD UTILIZING A REACTANCE CONTROLLED BY DEVELOPMENT OF OPPOSING MAGNETIC FLUXES

BACKGROUND OF THE INVENTION

1. Field of the Invention

The present invention relates to the field of power transferring devices of the type used to regulate or control the application of alternating current electric power to a load such as a motor, a heater, an instrument, or another device consuming electrical power. Typically such regulation or control of electric power is either manually adjusted according to precalibrated settings, or is automatically provided in response to a sensed load condition such as voltage, current, temperature, speed, humidity, or the like.

More particularly, the present invention relates to power transferring devices of the controlled reactance type inserting a variable reactance in a circuit to control the flow of power.

2. Description of the Prior Art

Various known arrangements utilize controlled reactances in order to provide controlled power transfer. One well known arrangement, providing independently controlled saturation of a reactor in response to a control signal, is described in various forms in the following U.S. Pat. Nos. 2,767,364; 3,061,770; 3,182,249; 2,497,218; 3,065,399; 3,263,158; and 2,725,508. Other known arrangements continuously vary reactance of a primary coil by varying the impedance of a secondary, as shown for example in U.S. Pat. No. 2,907,946.

These known arrangements have not proven entirely satisfactory. Although they control power transfer, they often require complicated, power-consuming controls which add cost and reduce efficiency in terms of power transfer. Such devices function to vary reactance by controlling the extent of magnetization to the point of saturation of a reactor core, and thus their performance is strongly influenced by the magnetization characteristics of the magnetic materials used and at times by the history of prior magnetization.

SUMMARY OF THE INVENTION

A principal object of the present invention is to provide an improved power transferring device of the controlled reactance type for regulating or controlling the application of alternating current electric power to a load. A specific object of the present invention is to provide such a power transferring device which can be controlled simply and with low power consumption, which achieves efficient power transfer, and which functions largely independently of core magnetization characteristics. Still another object of the invention is to provide a power transferring device which is more suitable for commercial use.

In accordance with the present invention, the power transferring device is of the controlled reactance type and is characterized by an arrangement which controls reactance by developing a controlled magnetic flux in opposition to the reactive magnetic flux, the resulting flux cancellation effectively eliminating reactance. Advantageously, the opposing magnetic field is developed by the signal to be controlled. The device includes a reactance means including a reactive core and a first coil encircling the reactive core and arranged to be connected into a circuit in which power transfer is to be controlled. The means for developing an opposing magnetic flux in the core includes a second coil encircling the reactive core and having one end connected to one end of the first coil. Controllable means, preferably a thyristor switch such as an SCR or triac, connect the other end of the first coil to the other end of the second coil to place the two coils in parallel. The first and second coils are arranged on the reactor core so that when they are connected in parallel, the magnetic flux which is produced by a current in the second coil opposes and cancels the magnetic flux produced by the parallel current in the first coil, thereby decreasing the amount of reactance of the two parallel coils from the amount of reactance of the first coil alone and increasing the amount of power transferred. By selective operation of the controllable means, the reactance of the device can be varied through a wide range. Advantages of this arrangement are that control is achieved simply and precisely with only the little power consumption occurring in the circuit through the second coil and controllable means, thereby enabling efficient power transfer. A further advantage is that the mode of operation, based on flux cancellation rather than controlled magnetization, reduces the importance of selection of magnetic materials.

In further aspects of the invention the controllable means connecting the two coils includes a variable resistance arranged to vary reactance by varying the amount of current flowing in the first and second coils, and the controllable means is operated in response to a sensed condition of the load.

Other objects, aspects and advantages of the invention will be pointed out in, or apparent from, the detailed description hereinbelow, considered together with the following drawings.

DESCRIPTION OF THE PREFERRED EMBODIMENTS

Figure 1:
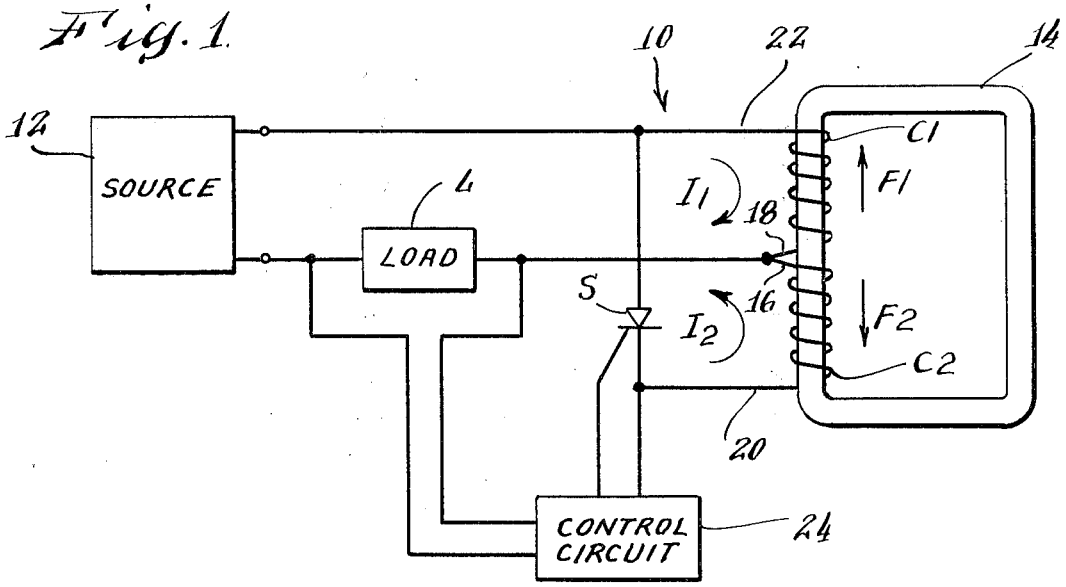
FIG. 1 is a schematic diagram illustrating a power transferring device in accordance with the present invention.

FIG. 1 illustrates schematically a controlled power transfer device 10 constructed according to the present invention and arranged to transfer controlled amounts of power from a source 12 of alternating current electric power, such as standard line voltage, to a load L, such as a motor, an instrument, a heater, or other power consuming element.

The controlled power transfer device 10, as shown in FIG. 1, varies reactance in order to control transfer of electric power. Device 10 comprises a reactive core 14 of magnetic material and a first coil C1 encircled around the reactive core 14 and connected into the circuit in which power is to be controlled, i.e., in series with the A.C. source 12 and load L.

A second coil C2 also encircles core 14 and has one of its ends 16 connected to one end 18 of the first coil. A controllable short-circuiting-switch element S, such as the illustrated SCR, connects the other end 20 of coil C2 to the other end 22 of coil C1. As shown in FIG. 1, the switch element S is connected to respond to control or gating signals supplied by a control circuit 24, typically in response to a sensed load condition such as the load voltage as depicted in FIG. 1, or current, motor speed, temperature, humidity, or the like.

When gated into conduction, switch element S places coils C1 and C2 in parallel; when it is not conducting, switch element S open-circuits coil C2. Coils C1 and C2 are arranged on the core 14 so that when they are connected in parallel, and parallel currents I1 and I2 flow through the coils, the magnetic flux F2 which is produced by current I2 in coil C2 opposes and cancels the magnetic flux F1 produced by current I1 in coil C1.

The operation of controlled power transfer device 10 is as follows. When switch element S is open-circuited, coil C2 is disconnected, and device 10 presents the reactance developed by coil C1 and core 14 standing alone. Core 14 and coil C1 function as a reactive choke: current I1 passing through coil C1 creates a magnetic flux F1 in core 14 which develops a counter electromotive force that opposes the flow of current and thereby limits the transfer of power. Core 14 and coil C1 are designed, therefore, to together provide sufficient reactance to block power flow down to the minimum level desired. Power transfer rates of as low as 0.5 percent generally may be obtained.

Power control is achieved by selectively short-circuiting switch element S. When switch element S is short-circuited, parallel currents I1 and I2 flow in coils C1 and C2. The resulting opposing magnetic fluxes cancel F1 and F2, thereby reducing counter electromotive forces and reducing the amount of reactance presented by device 10. The amount of power transferred to load L therefore increases. Power transfer rates during conduction of as high as 99.5 percent generally can be obtained.

By suitable controlling short-circuiting switch element S to provide different ratios of time for the conducting and non-conducting conditions of operation, power transfer rates may be arbitrarily selected in a continuously variable wide range of control.

The currents I1 and I2 in coils C1 and C2 will tend to divide so that the ampere turns in coil C1 will equal the ampere turns in coil C2 to provide maximum flux cancellation. Accordingly, coils C1 and C2 may be designed with appropriate numbers and ratios of turns to obtain desired levels of coil currents.

A particular advantage of the present invention is that control is achieved with little power loss. When switch element S is short-circuited, the only power losses in device 10 are those due to the passage of current through the small resistances in the coils C1 and C2, and those occurring in the switch element S. Accordingly, high efficiency in terms of power transfer can be obtained, without complex or expensive equipment. Moreover, the switch element S can control the application of large amounts of power to the load without being required to withstand a high rate of power dissipation itself.

The controllable short-circuiting switch element S preferably has a low impedance and low power consumption during conduction, and high impedance otherwise. SCR's, triacs, and other devices in the thyristor family, as well as transistor switches, are suitable for various applications. The control circuit 24, which may be of various known constructions, supplies a gating signal to the switch to control its conduction. The control circuit typically gates the switch S into conduction at a selected phase angle during each cycle of operation, with so-called "phase angle firing", the phase angle being selected either manually, or automatically in accordance with control circuitry. Other known control circuits, such as those using zero volt firing techniques, also are suitable.

Figure 2:
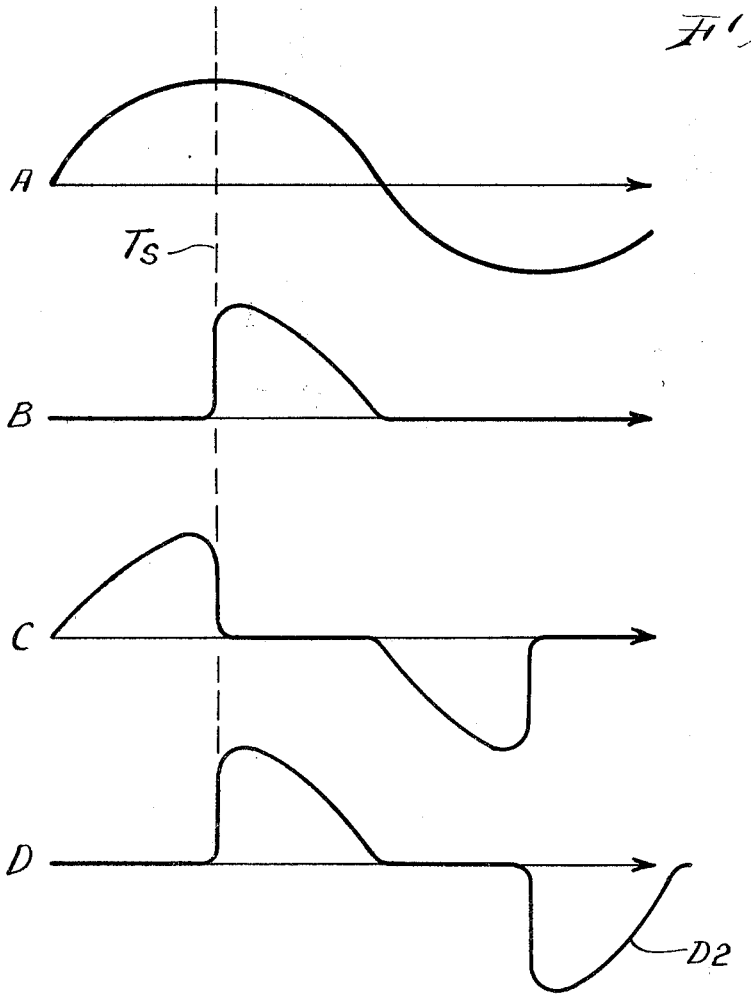
FIG. 2 is a graphic representation of typical waveforms appearing in the device of FIG. 1.

Waveforms showing an example of operation of power transfer device 10 are shown in FIG. 2 with a common horizontal time scale. In this example, the short-circuiting switch S is gated at a 90° phase angle to provide approximately a 50 percent power transfer rate. Curve A indicates the sinusoidal input voltage provided by voltage source 12. Curve B indicates the current through load L, which is I1 + I2. Curve C indicates the voltage across coil C1, and curve D the voltage across load L. Switch S is short-circuited at time $T_s$, and it can be seen that the voltage across coil C1 drops to a low value while load current and voltage rise and then follow the input voltage to transfer power to the load L.

Figure 3:
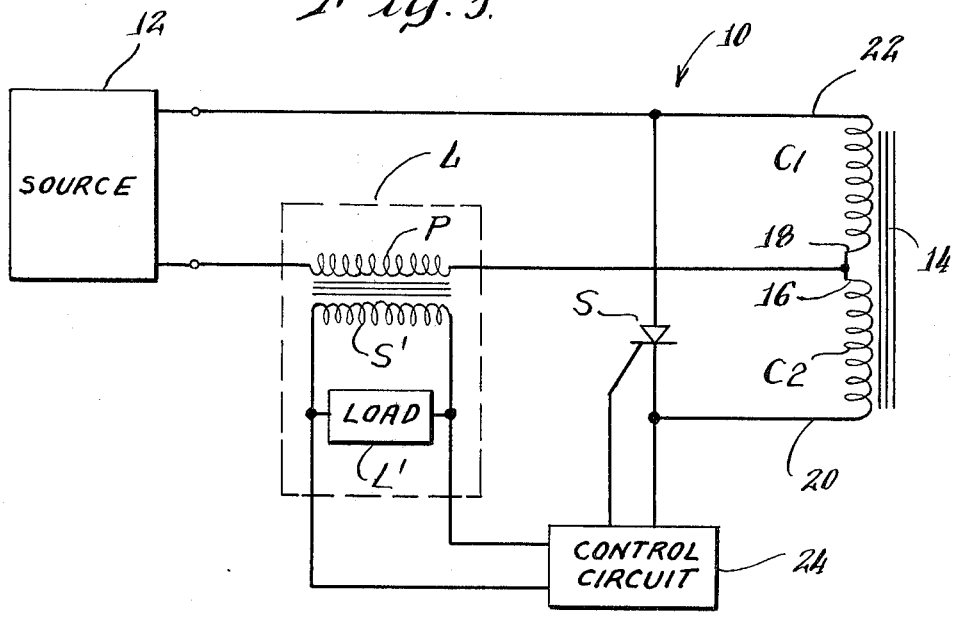
FIGS. 3 and 4 are schematic diagrams of further power transferring devices in accordance with the invention.

It will be noted that even though switch S is a unilaterally conducting element, such as an SCR, which can conduct only in one-half of a cycle, the residual magnetization of core 14 in the second half of the cycle will produce a second output wave D2 of opposite polarity, thus affording essentially full wave or A.C. control. A particular advantage of the present invention results from this phenomenon: As shown in FIG. 3, the load L may include a transformer T with a primary P in series with power transferring device 10, and a secondary S′ in series with load L′. Because full wave control results, no steady D.C. magnetizing current (as is produced for example by simple series SCR half-wave regulation) exists to saturate the transformer primary P and render it useless for supplying power to load L′. Accordingly, power transferring device 10 has a broad range of applications not open to other control devices and systems.

Figure 4:
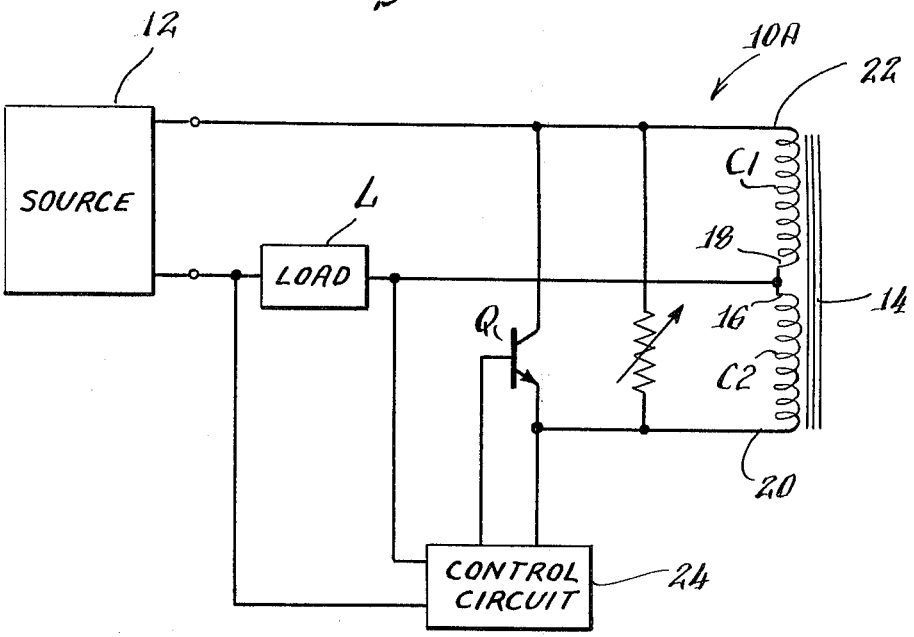

FIG. 4 illustrates a power transferring device 10A similar to that shown in FIG. 1 but employing a controlled transistor Q in place of switch S to control reactance. Transistor Q may be operated as a switching device, being changed between cutoff and saturation by control circuit 24 in a manner similar to switch S. Transistor Q also may be operated as a variable resistor to control the flux cancellation that occurs in core 14, thereby controlling the reactance presented by the parallel coils C1 and C2.

FIG. 4 further illustrates a variable resistor R connecting the two ends 20 and 22 of coils C1 and C2. Variable resistor R may be used in parallel with transistor Q (or switch S) and adjusted to reduce the maximum reactance of device 10 when that is desired in order to provide particular waveshapes for load L, or resistor R may be used alone to provide a variable reactance. Control of resistor R can be obtained manually, or through the operation of a motor, such as a servomotor responding to a sensed condition of load L.

Although specific embodiments of the invention have been disclosed herein in detail, it is to be understood that this is for the purpose of illustrating the invention, and should not be construed as necessarily limiting the scope of the invention, since it is apparent that many changes can be made to the disclosed structures by those skilled in the art to meet particular applications.

I claim:

1. A power transferring device of the controlled reactance type used to regulate or control the transfer of alternating current electric power from a source to a load, characterized by:

reactance means including a reactive core and a first coil encircling the reactive core and arranged to be connected into a circuit in which the transfer of power is to be controlled, the reactive core and first coil presenting a reactance blocking the transfer of power in the circuit;

a second coil encircling the reactive core and being connected at one end to one end of the first coil;

controllable switch means for selectively connecting the other end of the first coil to the other end of the second coil to place the two coils in parallel;

the first and second coils being arranged on the reactive core so that when they are connected in parallel, the magnetic flux which is produced by a current in the second coil opposes and cancels the magnetic flux produced by the parallel current in the first coil, whereby a small amount of reactance is presented to the circuit by the two parallel coils and power is freely transferred in the circuit;

the controllable switch means selectively switching the reactance of the device between the large blocking reactance provided by the first coil alone and the small reactance of the two parallel coils;

whereby the transfer of power is efficiently controlled by selectively connecting and disconnecting the two coils with little power dissipation occurring in the device in either condition of operation.

2. A power transferring device as claimed in claim 1 wherein the first and second coils have the same number of turns.

3. A power transferring device as claimed in claim 1 wherein the controllable switch means comprises a thyristor.

4. A power transferring device as claimed in claim 3 wherein the thyristor is an SCR.

5. A power transferring device as claimed in claim 1 wherein the controllable switch means comprises a transistor.

6. A power transferring device as claimed in claim 1 further comprising control circuit means providing a signal for controlling the switch means in response to a sensed load condition.

7. A power transferring device as claimed in claim 1 wherein the load comprises a transformer primary coil connected in series with the first coil.

8. A power transferring method of the type which controls a reactance to regulate or control the transfer of alternating current electric power in a circuit from a source to a load, characterized by:

generating a first blocking reactance across a coil for blocking the transfer of power in the circuit by producing a first magnetic field in a core within the coil;

connecting one end of a second coil to one end of the first coil, the second coil being around the core and arranged to produce a second magnetic field in the core opposing and cancelling the first magnetic field in the core when parallel currents flow in the two coils; and controllably operating switch means for selectively connecting the other end of the second coil with the other end of the first coil thus placing the coils in parallel and thereby cancelling flux in the core and generating a second small reactance for the two parallel coils which permits power to be transferred freely in the circuit;

the controllable switch means selectively switching reactance between the large blocking reactance provided by the first coil alone and the small reactance of the two parallel coils;

whereby the transfer of power is efficiently controlled by selectively connecting and disconnecting the two coils with little power dissipation occurring in either condition of operation.

9. A power transferring method as claimed in claim 8 further comprising the step of monitoring a selected condition of the load, and controllably connecting the two coils in response to the monitored condition.

10. A power transferring method of the type which controls a reactance to regulate or control the application of alternating current electric power to a load, as claimed in claim 8, wherein the step of controllably connecting the other ends of the first and second coils to place the coils in parallel comprises connecting said other ends during alternate half cycles of the alternating current electric power, thereby to produce a first output wave, and maintaining said other ends disconnected during the opposite half cycles of alternating current, whereby the demagnetization of the core during the opposite half cycles produces a second output wave of opposite polarity, thus affording a full wave controlled output and efficient power transfer.

11. A power transferring method as claimed in claim 10 wherein the step of controllably connecting the two coils comprises switching the two coils between connected and disconnected conditions.

12. A power transferring method as claimed in claim 11 wherein the step of switching the two coils between connected and disconnected conditions comprises gating an SCR joining said other ends of the first and second coils to cause the SCR to become conductive and connect the two coils in parallel.

13. A power transferring device of the controlled reactance type for controlling the transfer of power in a circuit from a source to a load, comprising:

means forming a core;

first coil means for developing a reactive flux in the core for blocking the transfer of power;

second coil means for developing a second flux in the core opposed to the reactive flux and cancelling the reactive flux to diminish the reactance through the coil means to freely transfer power therethrough, and switch means for selectively connecting and disconnecting the second coil means into the circuit to alternately block and freely transmit power through the circuit.

14. A power transferring device as claimed in claim 13 wherein a signal across the first coil means develops the reactive flux in the core, and wherein the second coil means for selectively developing a second flux in the core is operated by the same signal.

* * * * *